United States Patent [19]

Chadwick et al.

[11] Patent Number: 4,889,385

[45] Date of Patent: Dec. 26, 1989

[54] CHAIR SEAT-AND-BACK SUPPORT

[75] Inventors: Donald T. Chadwick, Los Angeles; Peter R. Glass, Capitola, both of Calif.

[73] Assignee: American Seating Company, Grand Rapids, Mich.

[21] Appl. No.: 165,745

[22] Filed: Mar. 9, 1988

[51] Int. Cl.[4] ..... A47C 1/02

[52] U.S. Cl. ..... 297/302; 297/301; 297/304; 297/286

[58] Field of Search ..... 297/300–304, 297/286, 289, 290, 325; 248/372.1, 575–578, 608, 629; 267/36.1, 52, 158

[56] References Cited

U.S. PATENT DOCUMENTS

| | | | |
|---|---|---|---|
| 386,142 | 7/1888 | Lewis | 297/301 |
| 1,379,270 | 5/1921 | McCollough, Jr. | 297/302 X |
| 1,964,424 | 6/1934 | Borah | 297/301 |
| 2,353,737 | 7/1944 | Lorenz | 297/304 X |
| 2,699,200 | 1/1955 | Lingle | 297/302 X |
| 3,297,360 | 1/1967 | Holmstrom | 297/300 |
| 4,131,315 | 12/1978 | Vogtherr | 297/421 X |
| 4,460,170 | 7/1984 | Lundberg et al. | 267/158 X |
| 4,703,974 | 11/1987 | Brauning | 297/300 X |

FOREIGN PATENT DOCUMENTS

| | | | |
|---|---|---|---|
| 49015 | 7/1934 | Denmark | 297/301 |

*Primary Examiner*—Peter R. Brown

*Attorney, Agent, or Firm*—Varnum, Riddering, Schmidt & Howlett

[57] ABSTRACT

A chair comprises an elongated one-piece seat-and-back support bent so as to form a lower substantially U-shaped seat support and an upper substantially upright back support. The seat support includes lower and upper leg portions and a bight portion intermediate the same. The bight portion is resilient thereby enabling the upper leg portion to deflect downwardly relative to the lower leg portion, and the back support to move downwardly and rearwardly, in response to a downward force exerted on the upper leg portion. In addition, the chair comprises a stabilizer mounted between the upper and lower leg portions of the seat support and for providing stability to the same during downward relative deflection of the upper leg portion. The chair further comprises resilient stiffening member and a tension control mechanism. The stiffening member is mounted to and between the seat support upper and lower leg portions and functions to increase resistance to relative deflection of the upper leg portion. The tension control mechanism is movably mounted relative to the lower leg portion of the seat support for adjustable engagement with the stiffening member to adjust the same's resistance to relative deflection of the seat support upper leg portion.

15 Claims, 7 Drawing Sheets

CHAIR SEAT-AND-BACK SUPPORT

THE FIELD OF THE INVENTION

The invention relates to seating and more particularly to chairs having one-piece seat-and-back supports.

BACKGROUND OF THE INVENTION

Chairs having one-piece seat-and-back supports are known. For example, St. John U.S. Pat. No. 293,813, issued Feb. 19, 1884, discloses a chair comprising an elongated seat-and-back support mounted on a floor-engaging base. The seat-and-back support comprises a lower, rigid, U-shaped seat support and an upper relatively resilient back support extending upwardly from the seat support. When a rearward and downward force is exerted on the seat-and-back support, the upper back support deflects backwardly and downwardly.

Although the back support of St. John's seat-and-back support is flexible, the seat support thereof is not. Thus, while the back support is designed to deflect downwardly and backwardly relative to the seat support in response to an occupant's weight, the seat support is not so constructed. Such design has been determined to be insufficient in providing the necessary comfort for users, especially in work environments where the chairs are occupied for extended periods of time.

It has thus been found desirable to provide a chair one-piece seat-and-back support comprising a U-shaped seat support with upper and lower leg portions and an intermediate bight portion, and a back support with a lower bight portion and an upright back portion, wherein both bight portions are flexible thereby enabling the seat support and the back support to adjustably respond at different rates of deflection to an occupant's weight. This chair design has been determined to be most adequate in providing the necessary comfort to the chair occupant.

It has also been found desirable to provide a resilient stiffening means, such a leaf spring, between the upper and lower leg portions of the seat support to strengthen the same and increase resistance to relative deflection of the upper leg portion of the seat support.

It should be noted that the use of leaf springs in chairs to resist tilting of seat supports are known, although such biasing means have not been used in chairs of the preferred type heretofore described. For example, Benzing U.S. Pat. No. 3,337,265, issued Mar. 4, 1965, discloses a chair comprising, in relevant part, a pair of inverted U-shaped sides connected by a pair of transverse and longitudinal horizontal supports. A pair of U-shaped springs are mounted on the transverse supports. A substantially L-shaped seat-and-back support is mounted on top of the springs. In this manner, when a rearward and downward force is exerted on the seat-and-back support, same reclines downwardly and backwardly against the tension of the springs.

In addition, Werner U.S. Pat. No. 3,740,792, issued June 26, 1973, discloses a chair comprises a box-like lower housing open at back and top portions thereof and mounted on top of a pedestal. An upper seat support is pivotally mounted to the housing on a horizontal shaft. A number of overlapping leaf springs surround the shaft and engage the housing and the seat support. The springs bias the seat support in a horizontal position. When a downward force is exerted on the seat support, the same pivots against the tension of the springs.

Benzing also provides for adjustment of the leaf springs' resistance to deflection of the seat support relative to the housing. Specifically, the tension of the springs is adjusted by turning a lever which displaces the springs forwardly and rearwardly toward and away from the pivotal axis of the seat support to increase the moment arm of the springs and thus vary the tension of the same.

In contrast to the leaf spring tension adjustment means disclosed by Benzing, it has been found desirable to provide tension adjustment means in a chair having a one-piece seat-and-back support, wherein the adjustment means adjustably engages the leaf spring along a longitudinal axis thereof to increase and decrease the effective length of the spring to thereby decrease and increase, respectively, the spring's resistance to deflection of the seat support.

SUMMARY OF THE INVENTION

According to the invention, a chair comprises a floor-engaging base and a one-piece seat-and-back support having a substantially U-shaped seat support and a back support. The seat support has a lower leg portion adapted to be supported by the base, an upper leg portion adapted to support a seat and a first bight portion intermediate the upper and lower leg portions. The back support has a second bight portion extending rearwardly and upwardly from the upper leg portion and a back support portion adapted to support a backrest.

The seat support is positioned centrally with respect to a central longitudinal axis of the chair. The first and second bight portions are resilient thereby enabling the upper leg portion to deflect downwardly relative to the lower leg portion and the back support to deflect downwardly and rearwardly relative to the upper leg portion. In this manner, the upper leg portion and the back portion are adapted to deflect downwardly and downwardly-and-rearwardly, respectively, in response to downward and rearward forces exerted on the upper leg portion and the back support.

The chair further comprises a support means mounted on the base and securely supporting the seat-and-back support at the lower leg portion thereof. The lower leg portion includes a slot means extending therethrough. A stabilizer means is mounted between the lower and upper leg portions for providing lateral stability to the seat support during relative deflection of the upper leg portion. Specifically, the stabilizer means is pivotally connected at an upper end thereof to the upper leg portion and at a lower end of the stabilizer means to the support means through the slot means. The pivotal connections accommodate deflection of the upper leg portion relative to the lower leg portion.

The chair also comprises a resilient stiffening means interposed between the lower and upper leg portions and for increasing resistance to deflection of the upper leg portion relative to the lower leg portion. A tension control means adjusts the stiffening means' resistance to relative deflection of the upper leg portion.

Specifically, the stiffening means comprises a strap-like leaf spring mounted to and between the lower and upper leg portions. The tension control means is adapted to adjustably decrease and increase the effective moment arm length between the leaf spring and the forces on the chair support to increase and decrease, respectively, the leaf spring's resistance to relative deflection of the upper leg portion.

The chair can further comprise on each lateral side thereof an elongated substantially V-shaped armrest mounted to and between the seat and back of the chair. The armrest is flexible along a portion thereof to accommodate relative deflection of the upper leg portion and the back support. Specifically each V-shaped armrest comprises substantially horizontal and diagonal legs rigid along substantially the full lengths thereof and a vertex portion intermediate the legs. The horizontal legs are adapted to support an occupant's arm. The horizontal and diagonal legs are rotatably mounted at free ends thereof to the seat and back, respectively, and the vertex portion is flexible to accommodate relative deflection of the upper leg portion and the back support.

BRIEF DESCRIPTION OF THE DRAWINGS

The invention will now be described with reference to the accompanying drawings in which.

DESCRIPTION OF THE PREFERRED EMBODIMENT

Figure 1:
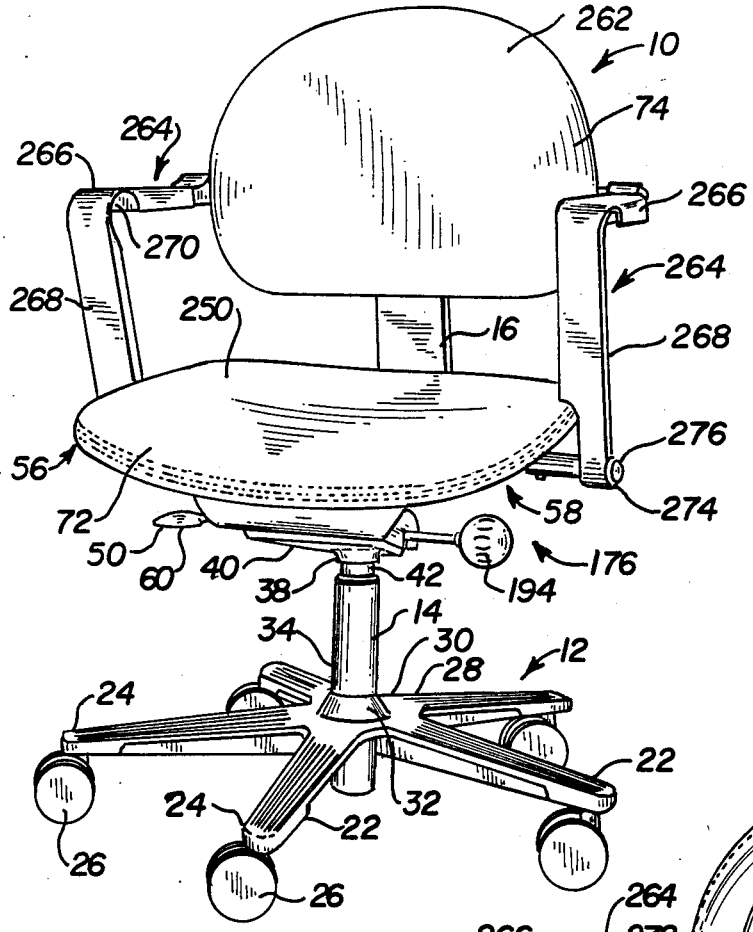
FIG. 1 is a front perspective view of a chair in accordance with the invention.

Referring generally to the drawings, there is shown a chair 10 comprising a castered base 12, a vertically adjustable pedestal 14 mounted to base 12 and an elongated one-piece seat-and-back support 16 mounted to the pedestal. The seat-and-back support is adapted to deflect downwardly and backwardly against the weight of an occupant. A resilient stiffening means 18 is provided for increasing the seat-and-back support's resistance to deflection. A tension control means 20 is provided for adjusting the tension of the stiffening means 18.

Referring now specifically to FIGS. 1-5, the chair base 12 comprises a plurality of equidistantly spaced arms 22 having mounted at outer ends 24 thereof floor engaging casters 26. Inner ends 28 of the arms 22 are connected by a central web 30 having a central socket 32 extending therethrough. The base 12 is preferably a one-piece member made of cast aluminum or Zytel (a glass reinforced nylon). Although the base 12 is illustrated as having five arms 22, any other number of arms can be used to provide the necessary support for the chair 10. The illustrated chair base 12 is of a similar type used in connection with a chair manufactured and sold under the trademark EQUA by Herman Miller, Inc., of Zeeland, Mich., Applicant's assignee of record. However, other suitable chair bases known in the art may be substituted for the illustrated base 12.

The pedestal 14 comprises a lower tube 34 securely received within the web socket 32 of the base 12 and an upper tube 36 above the lower tube and securely rotatably mounting at an upper end 38 thereof a support means 40 preferably made of die cast aluminum. A pneumatic air spring 42 is positioned between and partially received within the upper and lower tubes 34, 36 and comprises a piston (not shown) securely mounted to the web 30 and a cylinder 44 secured to the support means 40. The air spring 42 includes an adjustment pin 46 projecting upwardly from the upper axial end (not shown) of the cylinder 44 and through a vertical bore (not shown) in the support means 40. The pin 46 is adapted to move between an upper position, where the cylinder and piston of the air spring 42 are held stationary in locked engagement, and a lower position, where the cylinder and piston are released for movement relative to each other to extend or contract the air spring longitudinally. The adjustment pin 46 is normally biased in the upper, locked position. A height adjustment lever 50 is pivotally mounted to the support means 40, engages at an inside end 52 of the lever the adjustment pin 46 and extends outwardly from the casting at the lever outside end 54 at lateral side 56 of the chair 10. When the lever 50 is actuated by lifting upwardly on the outside end of the same, the lever inside end 52 forces the pin 46 to the lower position, thereby releasing the piston (not shown) relative to the cylinder 44 and thus allowing the pedestal 14 to extend or contract to raise or lower the chair upper portion 58. When the lever 50 is released, the pin moves to the upper position and the pedestal 14 becomes locked in the adjusted position. A hand knob 60 is provided at the lever outside end 54 to facilitate manual pivotal actuation of the lever 50.

Figure 3:
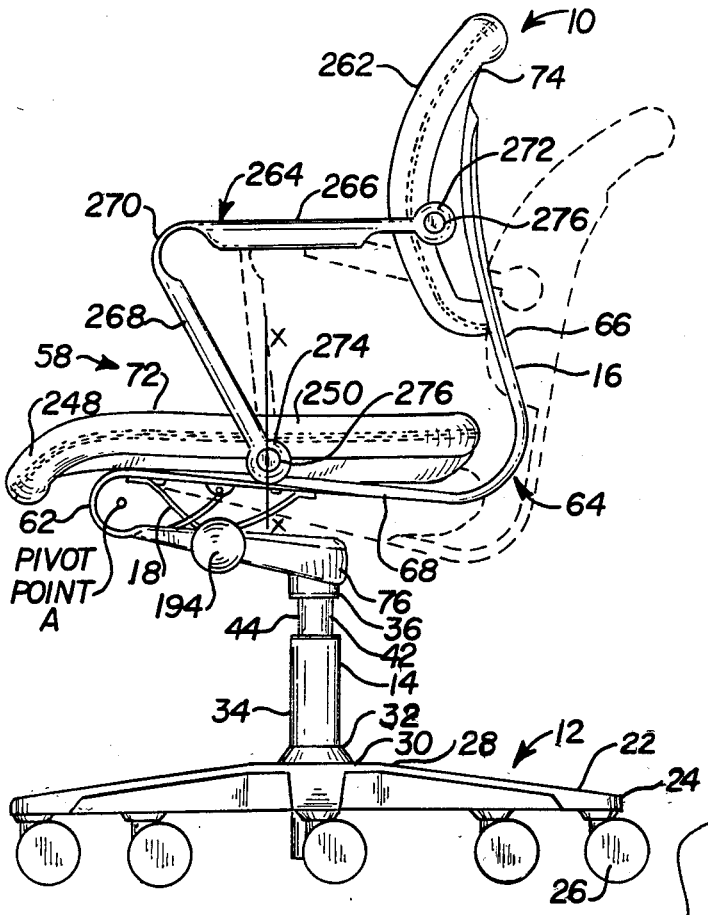
FIG. 3 is a side elevational view of the chair shown in FIG. 1.
Figure 4:
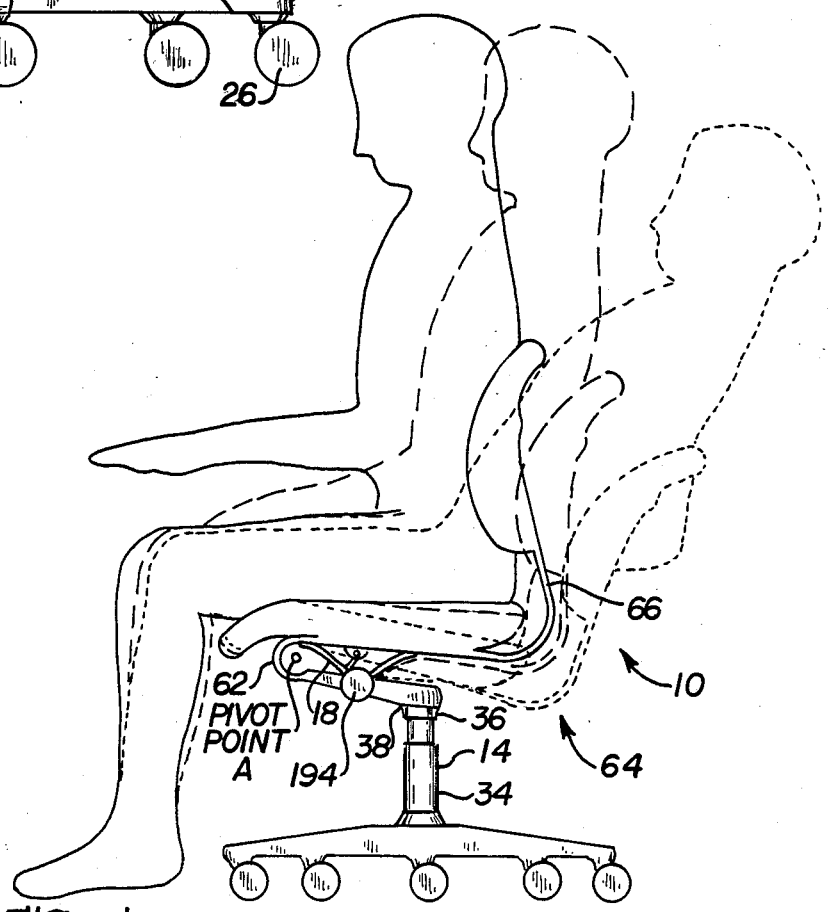
FIG. 4 is a side elevational view of the chair shown in FIG. 1 illustrating the chair tilting capability.
Figure 6:
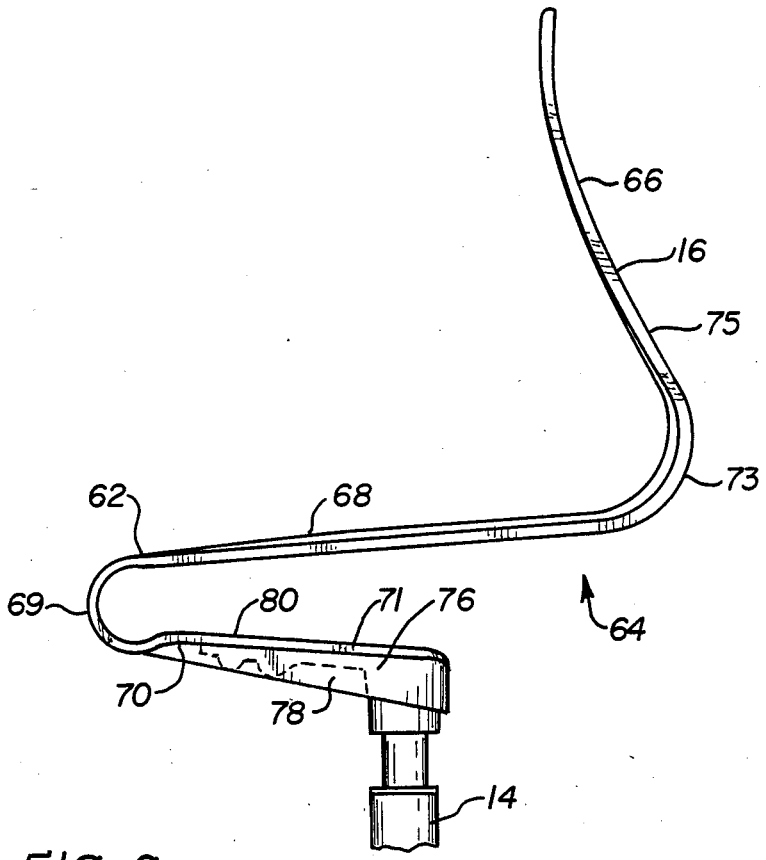
FIG. 6 is a detailed side elevational view of a seat-and-back support of the chair.

As shown in FIGS. 3, 4, and 6, the one-piece seat-and-back support 16 is mounted to the pedestal 14 and is bent so as to form a lower generally U-shaped seat support 62 open toward the chair back portion 64 and an upper, somewhat S-shaped back support 66. The seat support 62 comprises upper and lower leg portions 68, 70 and a first bight portion 69 intermediate the leg portions. The back support 66 comprises a second bight portion 73 extending rearwardly and upwardly from the upper leg 68 and an upper back support portion 75 extending upwardly from the second bight portion. The first and second bight portions 69, 73 are resilient and the upper and lower legs 68, 70 and the upper back support portion 75 are somewhat stiff.

Figure 2:
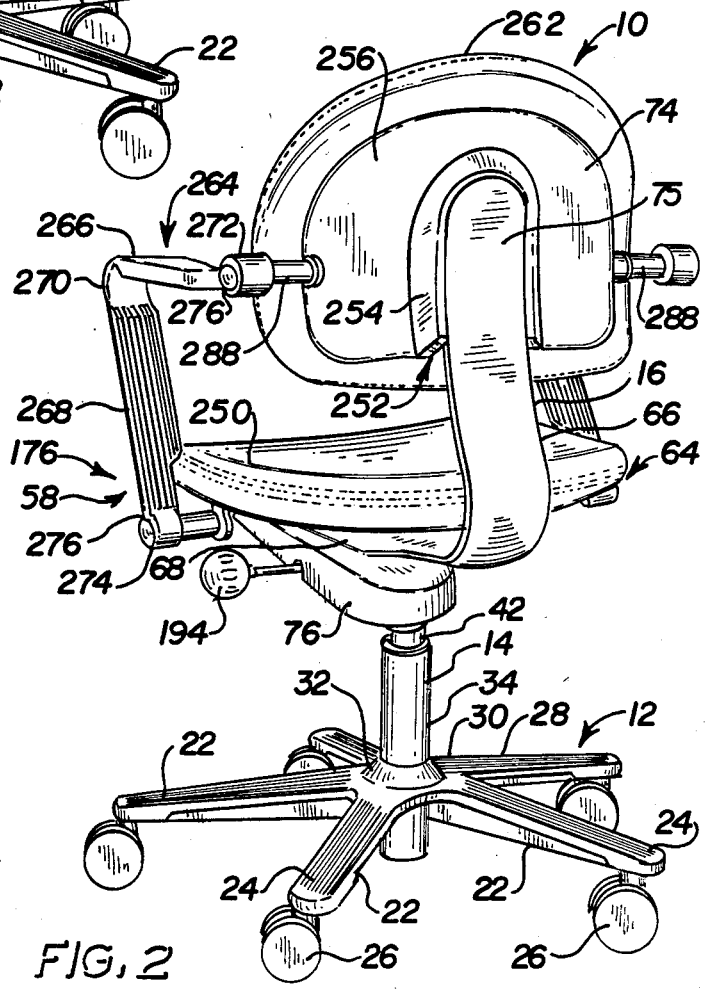
FIG. 2 is a rear perspective view of the chair shown in FIG. 1.
Figure 7:
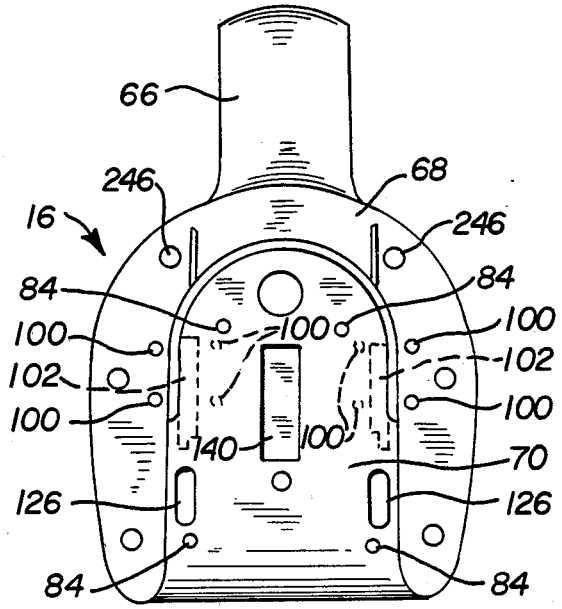
FIG. 7 is a bottom view of the seat-and-back support.

Referring to FIGS. 1, 2, and 7, the seat support upper leg 68 is enlarged or relatively wide with respect to the lower leg 70 of the seat support. In this manner, the upper leg 68 is adapted to accommodate mounting of the chair seat 72 thereto. The chair back 74 is mounted to the upper back support portion 75 of the back support 66. The mounting of the seat 72 and the back 74 to the seat-and-back support 16 is discussed below in detail.

As illustrated in FIGS. 5–8, the lower leg 70 of the U-shaped seat support 62 forms a downwardly oriented cover 76 at a rear end 71 of the leg. The cover 76 has a rearwardly and downwardly sloping U-shaped side wall 78 and a top wall 80. The cover 76 is complementary to, slidably received on and mounted to the support means 40. Mounting of the cover 76 and thus the seat-and-back support 16 to the support means 40 can be achieved by any suitable mechanical means, such as by plurality of bolts 82 in registry with a number of aligned holes 84 and threaded bores 86 of the cover and support casting, respectively. The cover 76 functions to protect elements of the height-adjustable pedestal 14 described above. Elements of the tension control means 20 are similarly protected by the cover 76 as will be described below.

As shown in FIGS. 3 and 4, when the weight of an occupant is exerted on the seat-and-back support 16, the first and second portions 69, 73 resiliently respond to deflect and move the seat-and-back support downwardly and backwardly between three general degrees of flex: a full upright "work intensive" position, a partially flexed "relaxed" position, and a "full tilt" position.

In the work intensive position, an occupant exerts minimal force on the back support 66 to impart limited deflection thereof. In the work intensive position, an occupant's weight is exerted downwardly on the chair seat 72, with some deflection of the seat support upper leg 68 relative to the lower leg 70.

In the relaxed position, an occupant is leaned slightly rearwardly exerting some degree of force on the back support 66. By leaning backwardly, an occupant shifts his/her center of gravity rearwardly away from a pivot point A. Displacement of the center of gravity increases the moment arm about pivot point A, thereby enabling the seat-and-back support 16 to flex rearwardly and downwardly. The flexing motion causes the S-shaped back support 66 to flatten slightly, thereby increasing the angle formed between the upper leg 68 of the seat support 62 and the back support 66.

Substantially maximum flex of the seat-and-back support 16 is achieved in the full tilt position obtained when an occupant exerts additional pressure on the back support 66. In this position, the outer angle between the seat support upper leg 68 and the back support 66 is maximized by the further downward and rearward seat-and-back support 16 deflection. In the full tilt position, a significant portion of an occupant's upper body weight is shifted to the chair back 74.

Therefore, the elongated one-piece seat-and-back support 16 is adapted to resiliently respond to shifts in an occupant's weight by smoothly flexing at the first and second bight portions 69, 73 thereof from an upright work intensive position to a partially relaxed position to a full tilt position as an occupant shifts his/her weight rearwardly against the back support 66. The novel design of the elongated one-piece flexible seat-and-back support 16 is such that the same is directly responsive to shifts in an occupant's weight to smoothly bend among the various degrees of flex heretofore described, with the upper leg 68 of the seat support 62 deflecting at a rate different from the rate of deflection of the back support 66. This different deflection rate is due to the differing downward and rearward load distributions exerted on the seat-and-back support when an occupant sits in the chair. To attain the desired resiliency, the seat-and-back support 16 is preferably made of Rynite (a glass reinforced polyester), or Zytel.

As illustrated in FIGS. 5, and 7–9, the chair 10 further includes a bridle 88 (hereinafter, sometimes referred to as the "stabilizer means") mounted to and between the upper and lower legs 68, 70 of the seat support 62 and for providing stability to the same during deflection of the seat-and-back support 16. Specifically, the bridle 88 comprises an upper bracket 90 mounted to the seat support upper leg 68 and a U-shaped stabilizer bracket 92 secured to and between the upper bracket and the support means 40.

The bracket 90 comprises an upper plate 94 and a pair of spaced bilateral flanges 96 preferably formed integral with the plate. The plate 94 is positioned above and mattingly engages the seat support upper leg 68 by a plurality of bolts 98 in registry with aligned holes 100 in the overlapping plate and seat support upper leg. The flanges 96 of the bracket 90 depend downwardly therefrom and are in registry with a pair of spaced slots 102 extending through the seat support upper leg 68.

The U-shaped stabilizer bracket 92 is pivotally mounted to the bracket 90 at upper ends 104 of spaced arms 106 of the stabilizer. To this end, each flange 96 of the bracket 90 includes a slot 108 forming a pair of spaced legs 110 having a pair of aligned openings 112 extending therethrough. The upper ends 104 of the arms 106 are received in the slots 108 and include holes 114 aligned with the aligned openings 112. A pair of pins 116 extend through the aligned openings 112 and holes 114 to pivotally mount the stabilizer arms 106 to the bracket 90.

The U-shaped stabilizer bracket 92 is also pivotally mounted at a lower bight portion 118 thereof to the support means 40 in sandwiched relationship between the same and the seat support lower leg 70. To this end, the support means 40 has formed therein a front transverse channel 120 in which a U-shaped, in cross section, shoe 122 complementary to the front transverse channel is received. The bight portion 118 of the stabilizer bracket 92 rotatably engages the shoe 122 and is fully received within the channel 120 such that there is sufficient clearance between the seat support lower leg 70 and the bight portion 118 to permit free rotation of the same with respect to the support means 40. Lower portions 124 of the stabilizer arms 106 are in slidable registry with a pair of spaced elongated slots 126 extending through the seat support lower leg.

In operation of the one-piece seat-and-back support 16, when an occupant's weight is exerted on the seat support 62, the upper leg 68 thereof deflects downwardly causing the arms 106 of the stabilizer bracket 92 to pivot about their mounting to the flanges 96, the arm lower ends 124 to register to a greater extent with the elongated slots 126 of the seat support lower leg 70 and the stabilizer bracket bight portion 118 to rotate within the front transverse channel 120 of the support means 40. In this manner, the bridle 88 accommodates relative movement of the upper and lower legs 68, 70 of the seat support 62 while a.. the same time performing its primary functions of resisting separation of the upper and lower legs 68, 70 when the chair 10 is not occupied and providing lateral stability to the U-shaped seat support 62 during flex of the same between the work intensive and full tilt positions.

To adjust the resistance to deflection of the seat-and back support 16 to accommodate occupants differing in weight, the chair 10 is provided with the resilient stiffening means 18 and the tension control means 20. As generally illustrated in FIGS. 3–5 and 8, the stiffening means 18 comprises an elongated strap-like leaf spring mounted to and between the upper and lower legs 68, 70 of the seat support 62. The geometry of the leaf spring will be hereinafter described in detail. The leaf spring resists downward relative movement of the seat support upper leg 68 when an occupant's weight is exerted thereon. The leaf spring is preferably made of a composite material such as unidirectional S-glass with an epoxy resin (i.e., glass-reinforced epoxy. The tension control means adjusts the leaf spring's resistance to deflection of the seat-and-back support 16. To this end, the tension control means 20 is adapted to adjustably decrease and increase the moment arm length between the leaf spring and the force exerted on the upper leg portion 68 to increase and decrease, respectively, the spring's resistance to relative deflection of the seat-and-back support.

The tension control means 20 generally comprises an adjustable engaging means 123 for adjusting the above-stated moment arm length, a mounting means 125 for movably mounting the engaging means to the support means 40 for movement between front and rear positions relative to the seat and back support and an actuating means 127 operably connected to the mounting means for actuating movement of the engaging means between the front and rear positions. In this manner, movement of the engaging means 123 toward the rear position decreases the effective length of the above-stated moment arm to thereby increase the leaf spring's resistance to deflection of the upper leg 70, and movement of the engaging means toward the front position increases the moment arm length to thereby decrease the spring's resistance to deflection of the upper leg. In this manner, the resiliency or resistance to deflection of the seat-and-back support 16 can be adjusted to comfortably accommodate occupants varying in weight. It may be surmised that a relatively heavy occupant would adjust the tension control means 20 to a position adjacent the rear position to increase resistance to deflection of the seat-and-back support 16, while an occupant of relatively light weight would set the tension control means closer to the front position to decrease the leaf spring's resistance to deflection of the seat-and-back support.

In one embodiment of the invention, illustrated in FIGS. 5 and 7–11, the resilient stiffening means 18 comprises a substantially bow-shaped leaf spring 128, having upper front and rear portions 130, 132 and a central portion 134. The spring front and rear portions 130, 132 reverse in curvature, the apexes of the curves freely slidably engaging front and back bottom surfaces 136, 138 of the seat support upper leg 68. In addition, the leaf spring 128 is mounted to, at the central portion 134 thereof, the tension control means 20. The tension control means is slidably mounted to the support means 40 through an elongated opening 140 in the seat support lower leg 70 for movement between the front and rear positions heretofore described.

Figure 8:
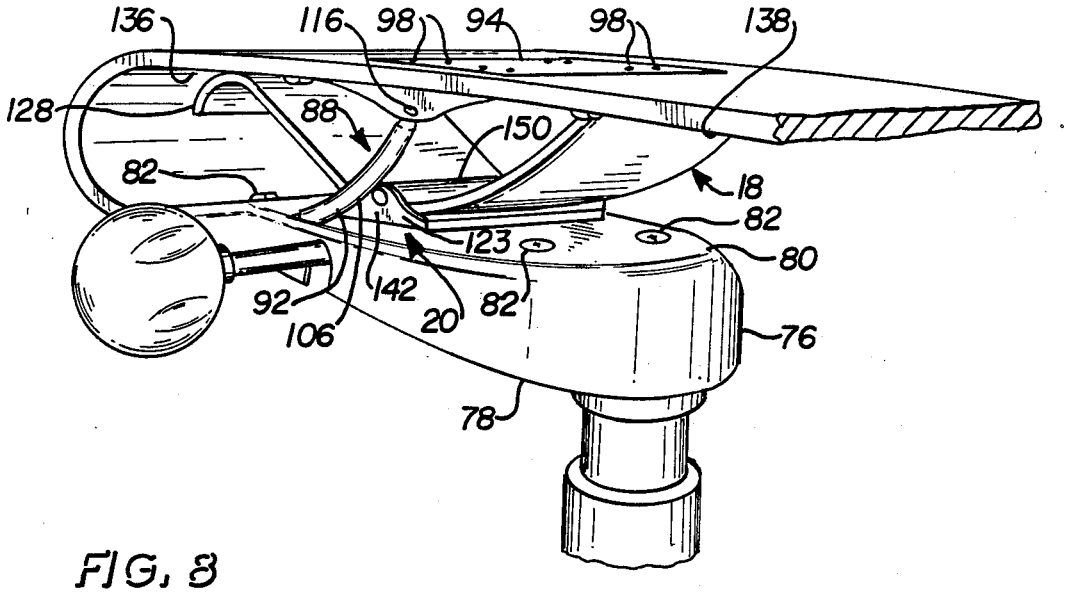
FIG. 8 is a fragmented perspective view of a seat support of the seat-and-back support illustrating the stabilizer means and the tension control means.
Figure 10:
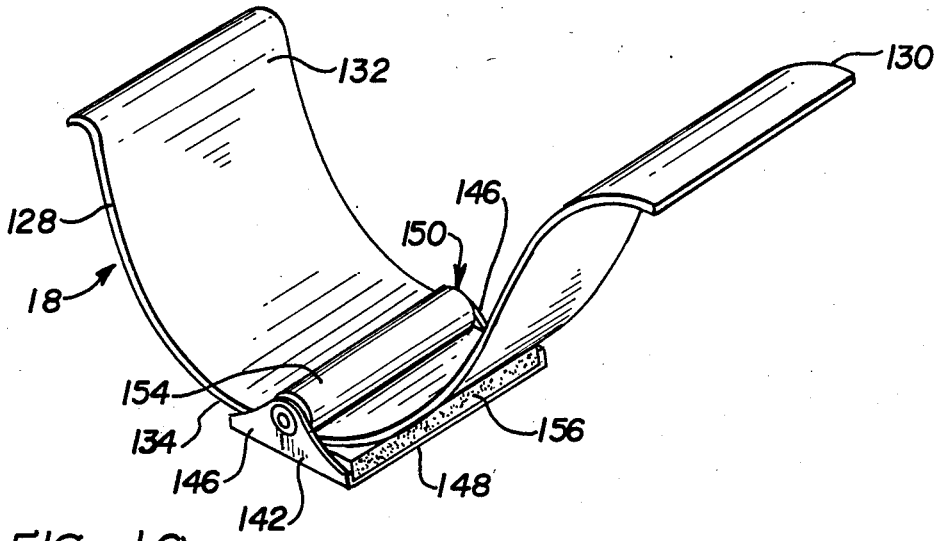
FIG. 10 is a perspective view of a stiffening means of the chair mounted to a cradle of the tension control means.
Figure 11:
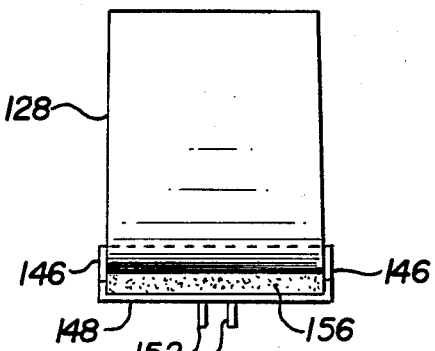
FIG. 11 is a front elevational view of the stiffening means and the cradle shown in FIG. 10.
Figure 15:
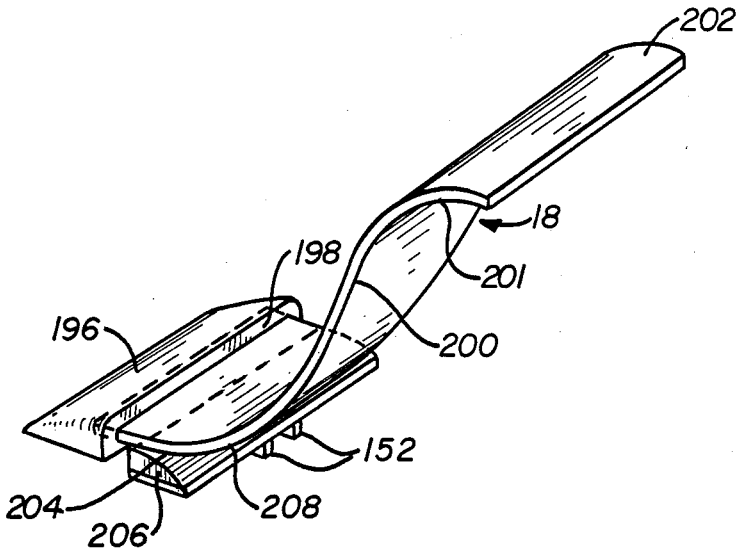

Referring now specifically to FIGS. 8 and 10–11 for a detailed discussion of the tension control means 20, the engaging means 123 thereof comprises a cradle 142 slidably mounted to the support means 40 for movement between the front and rear positions heretofore described through the elongated opening 140 in the seat support lower leg 70. The cradle 142 is positioned between the spaced stabilizer arms 106 of the bridle 88 and comprises a substantial U-shaped member having a pair of sidewalls 146, a bottom wall 148 and a transverse pin 150 mounted to and between the sidewalls in spaced relationship to the bottom wall. The bottom wall 148 has depending downwardly therefrom a pair of tangs 152 fixedly secured to the mounting means 125 of the tension control means 20. The leaf spring central portion 134 is captured between the transverse pin 150 and the cradle bottom wall 148. The cradle transverse pin 150 is preferably fitted with a rubber sleeve 154 and the cradle bottom wall 148 is preferably covered with a rubber sheet 156. The sleeve 154 and the sheet 156 function to eliminate noise otherwise caused by direct engagement of the spring center portion 134 with the cradle 142 during operation of the tension control means and caused by the variable deflection of the spring 128 during usage of the chair 10.

Figures 5, 14:
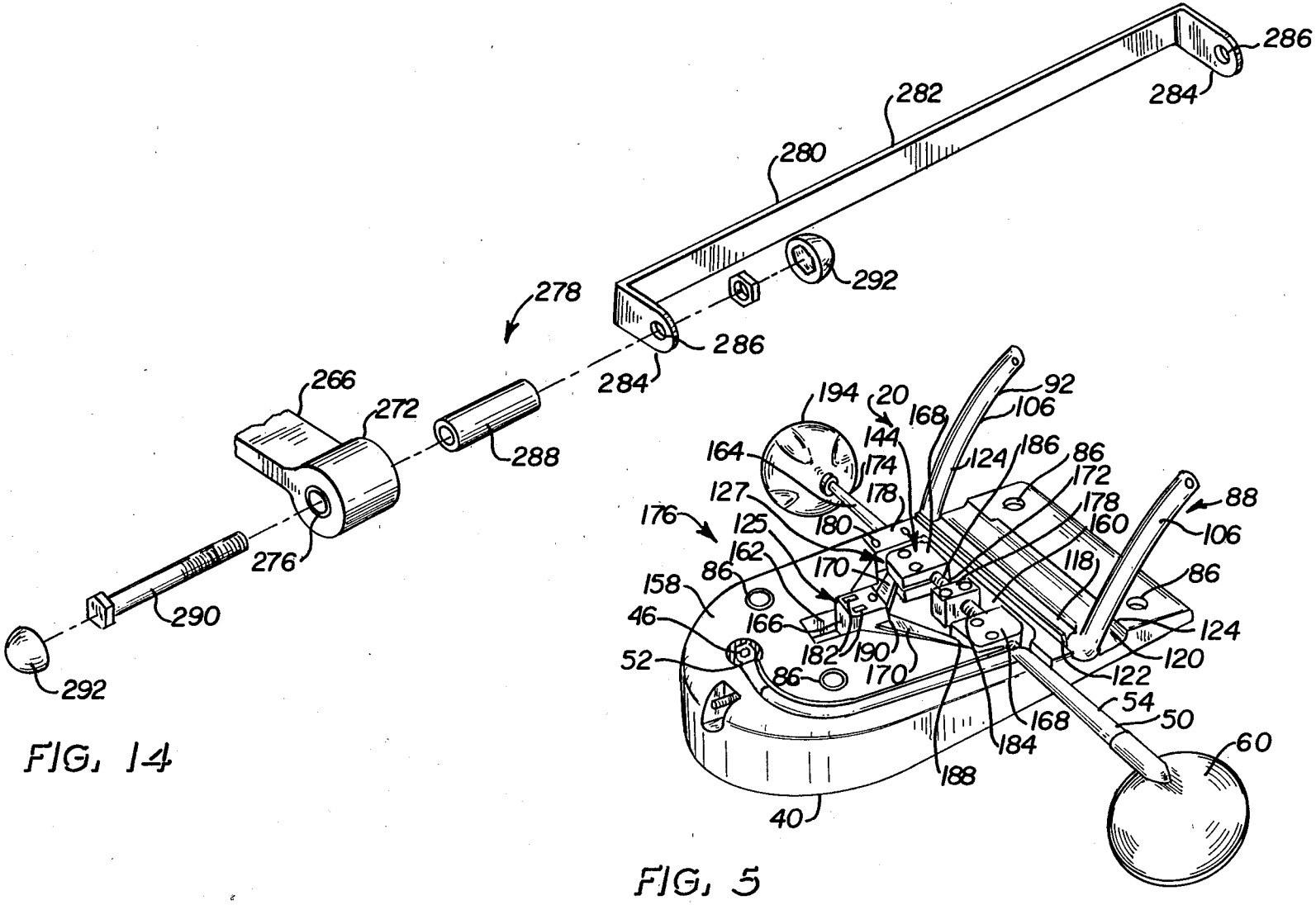
FIG. 5 is a perspective view of a support means of the chair and certain elements of a stabilizer means and one embodiment of a tension control means.
FIG. 14 is an exploded view of an armrest mounting means of the chair.

As seen in FIG. 5, the mounting means 125 comprises a scissor mechanism 144 slidably mounted to the support means 40 in substantially flush relationship to a top surface 158 thereof and beneath the seat support lower leg 70. The actuating means 127 comprises an adjustment rod 164 rotatably mounted to the support means 40 in substantially flush relationship to the same's top surface 58. To this end, the support means 40 has formed in the top surface 158 thereof rear transverse and longitudinal channels 160, 162. The transverse channel 160 is positioned rearwardly of the front transverse channel 120 associated with the bridle 88.

The adjustment rod 164 is rotatably received within the support means rear transverse channel 160 at an inner end 172 of the rod, the rod outer end 174 extending laterally outwardly from the support means 40 at chair lateral side 176 opposite the height adjustment lever 50. The rod 164 is mounted in rotatable registry with the transverse channel 160 by brackets 178 secured to the support means 40 by any suitable mechanical means, such as by screws 180 in registry with aligned holes (not shown) in the brackets and threaded bores (not shown) in the support means. The scissor mechanism 144 comprises a block 166, a pair of plates 168 and a pair of arms 170. The block 166 is slidably received within the longitudinal channel 162 of the support means 40 and includes a pair of shoes 182 in which the tangs 152 of the cradle 142 are securely received. The plates 168 include threaded portions (not shown) operatively engaging the threaded adjustment rod 164. Because the plate threaded portions (not shown) and their respective rod threaded portions 184, 186 are oppositely directed, rotation of the adjustment rod in one direction or the other causes the plates to move toward or away from each other. The arms 170 are pivotally mounted at front and rear ends 188, 190 thereof to and between the plates 168 and the block 166, respectively.

In this manner, when the adjustment rod 164 is rotated in one direction, the plates 168 move toward each other causing the scissor arms 170 to pivot and force the block 166 toward the rear position of the tension control means 20. Rearward movement of the block 166 forces the cradle 142 and leaf spring 128 rearwardly, thereby decreasing the moment arm length between the spring and the force exerted by the occupant on the rear portion of the seat support upper leg 68 to increase the spring's resistance to deflection of the seat-and-back support 16. When the rod 164 is rotated in the opposite direction, the plates 168 move away from each other causing the scissor arms 170 to pivot and force the block 166 forwardly. Forward movement of the block 166 forces the cradle 142 and the spring 128 forwardly, thereby increasing the moment arm length and decreasing the spring's resistance to deflection of the seat-and-back support 16.

To facilitate manual rotation of the adjustment rod 164, the same is provided on the outer end 174 thereof with a hand knob 194. The hand knob 194 preferably differs in geometry from the height adjustment knob 60 so that the knobs can be easily differentiated by an occupant.

As indicated above, certain elements of the tension control means 20 are enclosed by the seat support lower leg cover 76 and are thus protected from damage and accumulation of dust which can affect operation of the tension control means.

Figure 12:
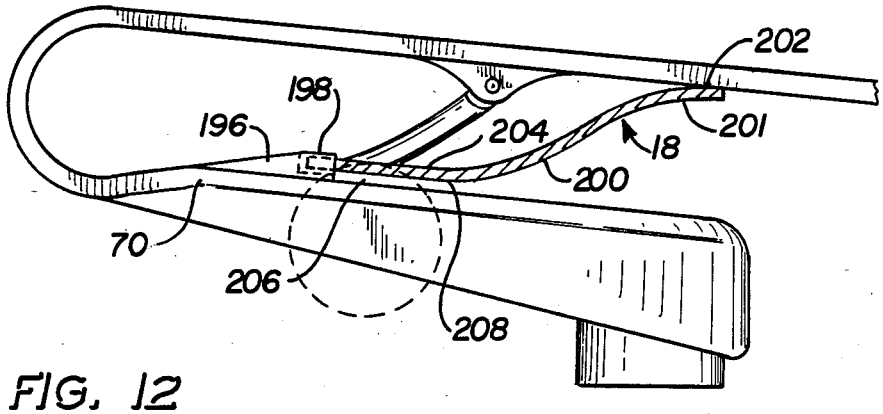
FIG. 12 is a side elevational view of a second embodiment of the tension control means.

In a second embodiment of the invention, illustrated in FIG. 12, the tension control means 20 further comprises a retainer 196 securely mounted to the seat support lower leg 70 and having an open rear portion 198 providing access to the interior of the retainer. The retainer 196 can be formed integrally with the seat support lower leg 70 or be separate therefrom but mounted to the seat support by any suitable mechanical means. The stiffening means 18 comprises a substantially S-shaped leaf spring 200 having an upper curved end 201 freely engaging the seat support upper leg rear part at an apex 202 of the curved end, and a lower substantially straight end 204 received within and secured to the retainer 196 through the open rear portion 198 thereof. In this embodiment of the invention, the elements of the tension control means 20 are substantially identical to those of the above-described embodiment except that in the embodiment of FIG. 12, a fulcrum pad 206 is mounted to the block 166 rather than the cradle 142. Like the cradle 142, however, the fulcrum pad 206 is set in slidable registry with the elongated opening 140 of the seat support lower leg 70 and includes tangs (not shown in FIG. 12) engaging the shoes 182 of the block 166. The pad 206 is set in slidable engagement with a bottom surface 208 of the leaf spring straight end 204. In addition, like the cradle 142, the fulcrum pad 206 is adapted to move between the front and rear positions heretofore described to alter the moment arm length and thereby adjust the spring's resistance to deflection of the seat-and-back support 16. However, in this embodiment, the leaf spring does not move relative to the seat support. Rather, the fulcrum pad 206 adjustably engages the spring along the longitudinal axis thereof to adjust the effective length of the spring and vary the above-stated moment arm. Specifically, upon rotation of the adjustment rod 164 in one direction, the fulcrum pad 206 moves rearwardly to shorten the effective length of the spring, thereby reducing the moment arm length between the spring and the force and increasing the spring's resistance to relative downward movement of the seat support upper leg 68. When the fulcrum pad 206 is moved toward the front position of the tension control means, the moment arm is increased, thereby decreasing the spring's resistance to downward relative movement of the seat support upper leg 68. Consequently, when a relatively light occupant uses the chair, the fulcrum pad 206 is positioned adjacent the front position of the tension control means 20. Alternatively, when a heavy occupant uses the chair 10, the fulcrum pad 206 is positioned closer to the rear position of the tension control means 20.

Figure 13:
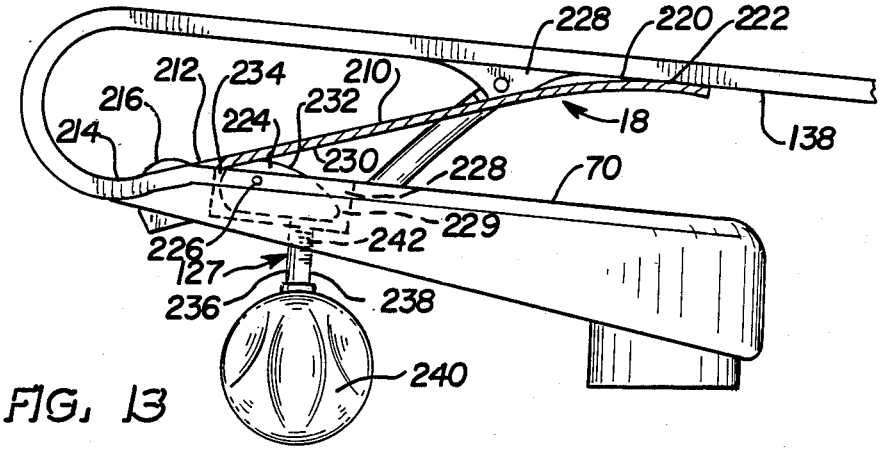
FIG. 13 is a side elevational view of a third embodiment of the tension control means.
Figure 9:
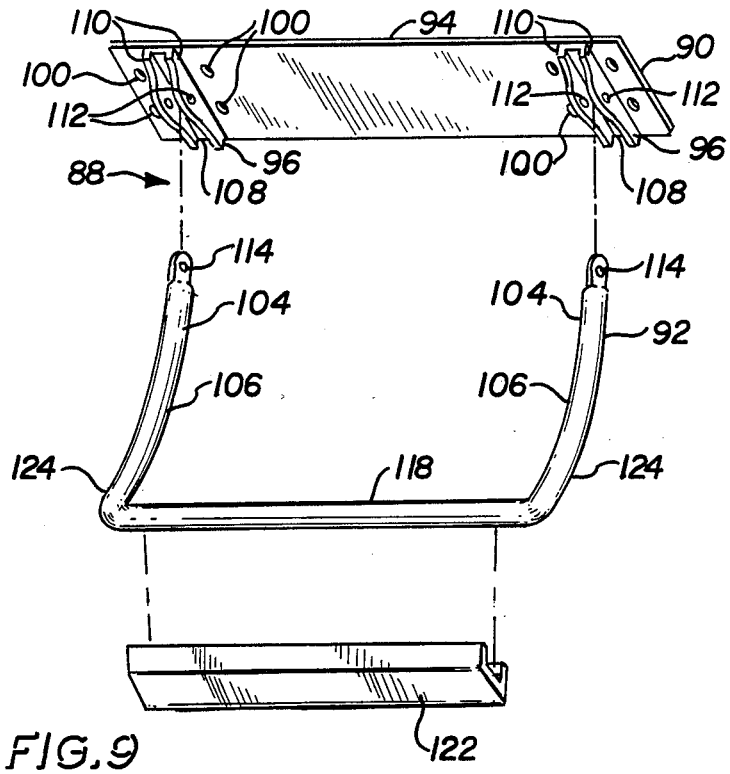
FIG. 9 is an exploded view of the stabilizer means.

In a third embodiment of the invention, illustrated in FIG. 13, the stiffening means 20 comprises a substantially straight leaf spring 210 having the lower front end 212 thereof fixedly secured to the seat support lower leg front part 214 by any suitable mechanical means, such as by a plurality of bolts 216 in registry with an equal number of pairs of aligned holes (not shown) extending through the spring front end 212 and the lower leg front part 214. An upper rear end 220 of the leaf spring 210 is bent along a gradual curve, the apex 222 of which freely mattingly engages the seat support upper leg rear part 138.

In the tension control means 20 of the embodiment illustrated in FIG. 13, the engaging means 123 comprises a cam pad 224 mounted about a horizontal axis of rotation on a pin 226 forming the mounting means 125 and rotatably secured transversely to and between opposing sidewalls 78 of the seat support lower leg cover 76. The cam pad 224 is set in registry with an enlarged opening 228 extending through the seat support lower leg 70 and an enlarged channel 229 within and the support means 40. The cam pad 224 engages a bottom surface 230 of the leaf spring 210 at a rear part 232 of the pad. The cam pad 224 is somewhat triangular in shape, with the rear end 232 thereof being enlarged relative to a front end 234 of the pad. Due to this geometry, rotation of the same in one direction causes the pad to move rearwardly and upwardly and to engage the spring lower front portion 212 to a greater extent to thereby shorten the effective length of the spring and decrease the moment arm length between the spring and the force exerted on the seat by the occupant. The result is an increase in the spring's resistance to deflection of the seat support upper leg 68. Rotation of the pad 224 in the other direction moves the same forwardly and downwardly to thereby increase the spring effective length and consequently increase the moment arm length to reduce the spring's resistance to deflection.

The actuating means 127 comprises an adjustment shaft 26 threadably mounted to the support means 40 through a vertical threaded bore (not shown) of the same, and has a lower end 238 extending downwardly from the support means and mounting a handwheel 240 and an upper end 242 above the casting and in abutting engagement with the cam pad rear end 232.

In operation, rotation of the handwheel 240 in one direction threads the adjustment shaft 236 upwardly to force the cam pad 224 about its pivot axis and rearwardly and upwardly against the leaf spring lower front end 212. The effective length of the leaf spring 210 is thereby decreased, reducing the moment arm length and therefore increasing the spring's resistance to deflection of the seat support upper leg 68. Conversely, upon rotation of the handwheel 240 in the other direction, the shaft 236 is adjusted downwardly to lower the rear portion 232 of the cam pad 224 to thereby increase the effective length of the spring 210 and the moment arm length and thereby decrease the same's resistance to deflection of the upper leg 68.

Referring now to FIGS. 1–3 and 7, the chair seat 72 comprises an inner shell (not shown) and an outer structural shell (not shown) and is mounted to and above the seat support upper leg 68 by any suitable mechanical means, such as by a plurality of screws (not shown) in registry with aligned holes 246 extending through the seat outer shell and the seat support upper leg. The shape of the seat 72 is complementary to that of the seat support 62, but enlarged with respect thereto to provide the necessary comfort and support to the occupant. In addition, the seat front portion 248 is rolled over to comfortably accommodate an occupant's legs. A cushion 250 is molded to the top of the inner shell. The inner shell is removably fastened by any suitable snap means to the outer shell. By this method, the seat cushion 250 can be replaced as necessary. The seat 72 is preferably made of zytel or polypropylene, compositions which provide some degree of flexibility to the seat during flex of the seat and-back support 16.

As illustrated in FIGS. 1–3 the chair back 74 is substantially half oval in shape and has an enlarged U-shaped channel 252 within a central relief portion 254 formed on a rear surface 256 of the back. The back 74 comprises an inner and an outer shell (not shown), the outer shell being securely fastened to the back support 66, with the same received within the channel 252 and flush with respect to the relief portion 254 by any suitable mechanical means, such as by a plurality of screws (not shown) extending through aligned orifices (not shown) in the back and the back support. Like the chair seat 72, the back 74 is preferably made of a material such as zytel or polypropylene to provide flexibility of the back. The chair back 74 is enlarged with respect to the back support and in this manner functions to distribute the weight transferred from the occupant to the chair seat and back support as the occupant leans rearwardly in the same between the upright and full tilt positions. A cushion 262 is molded to the inner shell, the same being removably fastened by any suitable snap means to the outer shell. By this method, the back cushion 262 can be replaced as necessary.

As illustrated in FIGS. 1–3, the chair can be provided with a pair of optional armrests 264 mounted on opposite lateral sides 56, 176 of the chair 10. Specifically, each armrest 64 is a substantially V-shaped flexible member having, with reference to the work intensive position of the seat-and-back support 16, a substantially horizontal leg 266 and a diagonal leg 268, free ends of the horizontal and diagonal legs being rotatably mounted to the back 74 and the seat 72, respectively, at a lateral side 56 or 176 of the chair. The horizontal leg 266 provides support for an occupant's arm. In this manner, as the seat-and-back support 16 flexes downwardly and backwardly in response to a shift in an occupant's weight, the armrests 264 likewise flex thereby accommodating the changing geometry of the seat-and-back support. Flex of the V-shaped armrests generally occurs at the vertices 270 of the Vs, due to the rotatable connection between the armrests and the seat 72 and back 74. Each armrest 264 is substantially rectangular, in cross section, with the thickness thereof tapering substantially at the vertex 270 of the V. A reduction of thickness at the vertex facilitates the resiliency of the armrest 264.

As stated above, the armrests 264 are rotatably mounted to the chair back 74 and the chair seat 72 at lateral sides 56, 176 of the chair 10. To this end, the free ends 272, 274 of the horizontal and diagonal legs 266, 268, respectively, have formed thereon sockets 276. In addition, an attachment means 278 is provided for mounting the armrests 264 to the seat 72 and the back 74.

As best seen in FIG. 14, the armrest attachment means 278 comprises a pair of U-shaped brackets 280, each having a web portion 282 and a pair of side portions 284. Each side portion 284 includes a hole 286 extending therethrough. One bracket 280 is securely mounted to and between the chair back shells, with the web portion 282 sandwiched therebetween and the side portions 284 extending rearwardly of the chair. A recess in the inner chair back shell (not shown) accommodates the bracket web. The other bracket 280 is mounted to and between the chair seat shells, the web portion 282 sandwiched therebetween and the side portions 284 extending downwardly from the chair seat 72. A recess in the inner chair seat shell (not shown) accommodates the bracket web.

The attachment means 278 further comprises a hollow tubular spacer 288 partially received within each armrest socket 276, the spacer being aligned with a respective hole 286 in the U-shaped bracket 280. Bolts 290 extend through the aligned sockets 276, spacers 288 and holes 286 to securely mount the armrest 264 to the brackets 280. Hemispherical protective caps 292 can be placed over the bolts 290.

While the invention has been described in connection with a preferred embodiment, it will be understood that I do not intend to limit the invention to that embodiment. To the contrary, I intend to cover all alternative modifications and equivalents as may be included within the spirit and scope of the invention as defined by the appended claims.

I claim:

1. A chair comprising:

a seat;

a support having a substantially U-shaped seat support including a lower leg portion with slot means extending therethrough, an upper leg portion supporting said seat and a first bight portion intermediate said upper and lower leg portions, said first bight portion being resilient thereby enabling said upper leg portion to deflect downwardly relative to said lower leg portion in response to downward forces exerted on said upper leg portion;

support means mounting said support at said lower leg portion thereof; and stabilizer means for providing lateral stability to said support during relative deflection of said upper leg portion, said stabilizer means being pivotally connected at an upper end thereof to said upper leg portion and at a lower end of said stabilizer means to said support means through said slot means, said pivotal connections accommodating relative deflection of said upper leg portion.

2. In a chair according to claim 1, wherein said chair further comprises a backrest; and said support further comprises a back support having a back support portion supporting said backrest and a second bight portion extending rearwardly and upwardly from said upper leg portion, said second bight portion being resilient thereby enabling said back support to deflect downwardly and rearwardly relative to said upper leg portion;

whereby said upper leg portion and said back support are adapted to deflect downwardly and downwardly-and-rearwardly, respectively, in response to downward and rearward forces exerted on said upper leg portion and said back support.

3. In a chair according to claim 2, wherein adjacent portions of said one-piece seat-and-back support are integral with one another.

4. In a chair according to claim 3, wherein said one-piece seat-and-back support is constructed of a glass reinforced polyester.

5. In a chair according to claim 3, wherein said one-piece seat-and-back support is constructed of a glass-reinforced nylon.

6. In a chair according to claim 2, and further comprising on each lateral side thereof an elongated substantially V-shaped armrest mounted to and between said seat and said backrest and flexible along a portion thereof to accommodate relative deflection of said upper leg portion and said back support.

7. In a chair according to claim 6, wherein each of said V-shaped armrests comprises substantially horizontal and diagonal legs rigid along substantially the full lengths thereof and a vertex portion intermediate said legs, said horizontal leg adapted to support an occupant's arm, said horizontal and diagonal legs being rotatably mounted at free ends thereof to said seat and said backrest, respectively, and said vertex portion being flexible to accommodate relative deflection of said upper leg portion and said back support.

8. In a chair according to claim 1, wherein said support means comprises a front transverse channel formed therein, said slot means comprises a pair of spaced elongated first slots extending through said lower leg portion, said upper leg portion comprises a pair of spaced second slots extending therethrough and said stabilizer means comprises:

an upper bracket positioned above and engaging said upper leg portion and having a pair of downwardly-depending flanges in registry with said spaced second slots, each of said flanges having a third slot extending upwardly from a base thereof forming a pair of spaced legs with a pair of aligned first holes extending therethrough;

a substantially U-shaped bracket comprising a pair of arms and a bight portion intermediate said arms, said bight portion being in rotatable registry with said front transverse channel in sandwiched relationship between said support means and said lower leg portion, and said arms being in registry with said first slots at lower ends of said arms and in registry with said third slots at upper ends of said arms and having a pair of second holes extending through said upper ends and aligned with said third slots; and a pair of first pins in registry with said aligned first and second holes to pivotally connect said U-shaped bracket to said upper leg portion;

whereby movement of said upper leg portion relative to said lower leg portion causes said arms to pivot relative to said upper leg portion, said arms to register with said first slots to one of a greater and lesser extent and said bight portion to rotate relative to said lower leg portion to accommodate relative movement of said upper leg portion.

9. A chair comprising:

a seat;

support means;

a substantially U-shaped seat support mounted on said support means, said seat support having a lower leg portion with an elongated opening therethrough, an upper leg portion supporting said seat and a bight portion intermediate said upper and lower leg portions, said bight portion being resilient thereby enabling said upper leg portion to deflect downwardly relative to said lower leg portion in response to forces exerted on said upper leg portion in response to forces exerted on said upper leg portion;

resilient stiffening means interposed between said lower and upper leg portions for increasing resistance to relative deflection of said upper leg portion; and adjustable tension control means for adjusting said stiffening means' resistance to relative deflection of said upper leg portion, said tension control means comprising means for engaging said stiffening means, means for movably mounting said engaging means relative to said support means through said elongated opening of said lower leg portion for movement between front and rear positions relative to said seat support, and means operably connected to said mounting means for actuating movement of said engaging means between said front and rear positions;

whereby movement of said engaging means toward said rear position decreases effective moment arm length between said stiffening means and said forces on said upper leg portion to increase said stiffening means' resistance to relative deflection of said upper leg portion, and movement of said engaging means toward said front position increases said moment arm length to thereby decrease said stiffening means' resistance to relative deflection of said upper leg portion.

10. In a chair according to claim 9, wherein said support means comprises rear transverse and longitudinal channels formed therein;

said stiffening means comprises a substantially bow-shaped leaf spring interposed between said upper and lower leg portions and having upper front and rear portions slidably engaging said upper leg portion and a lower center portion positioned adjacent said lower leg portion;

said engaging means comprises a substantially U-shaped cradle bracket having a pair of sidewalls, a bottom wall, tang means depending downwardly from said bottom wall for securely engaging said mounting means, and a pin connected to and between said sidewalls, said leaf spring center portion being captured between said pin and said bottom wall;

said actuating means comprises a threaded rod having inner and outer ends, rotatably received in said rear transverse channel at said inner end in sandwiched relationship between said support means and said lower leg portion and extending outwardly laterally of said support means at said outer end; and said mounting means comprises a block slidably received in said rear longitudinal channel for forward and rearward movement relative to said support means and having means for securely receiving said tang means; a pair of arms having first and second ends and pivotally mounted at said first ends to said block; and threaded mounting means pivotally mounted to said arm second ends and for threadably mounting said arms to said rod such that rotation of said rod in first and second directions causes said arm second ends to move toward and away from each other, respectively;

whereby rotation of said rod in said first and second directions causes said arm second ends to move toward and away from each other and said arms to pivot relative to said threaded mounting means and said block to force said block rearwardly and forwardly and said cradle and said leaf spring toward said rear and front positions to shorten and lengthen the said moment arm length and increase and decrease said leaf spring's resistance to deflection of said upper leg portion, respectively.

11. In a chair according to claim 10, wherein said lower leg portion forms a cover complementary to said support means and for protecting portions of said tension control means.

12. In a chair according to claim 9, wherein said support means comprises rear longitudinal and transverse channels formed therein;

said stiffening means comprises a somewhat S-shaped leaf spring interposed between said upper and lower leg portions and having an upper curved end slidably engaging said upper leg portion and a lower substantially straight end;

said tension control means further comprises a means for securely retaining said leaf spring lower end to said lower leg portion for nonmovement with respect thereto;

said engaging means comprises a fulcrum pad adjustably engaging said leaf spring and having tang means for securely engaging said mounting means;

said actuating means comprises a threaded rod having inner and outer ends, rotatably received in said rear transverse channel in sandwiched relationship between said support means and said lower leg portion at said inner end and extending outwardly laterally of said support means at said outer end; and said mounting means comprises a block slidably received in said rear longitudinal channel for forward and rearward movement relative to said support means and having means for securely receiving said tang means; a pair of arms having first and second ends and pivotally mounted at said first ends to said block; and threaded mount means pivotally mounted to said arm second ends for threadably mounting said arms to said rod such that rotation of said rod in first and second directions causes said arm second ends to move toward and away from each other, respectively;

whereby rotation of said rod in said first and second directions causes said arm second ends to move toward and away from each other and said arms to pivot relative to said threaded mounting means and said block to force said block rearwardly and forwardly and said fulcrum pad toward said rear and front positions against said leaf spring to shorten and lengthen the effective length of the same and said moment arm length and increase and decrease said leaf spring's resistance to deflection of said upper leg portion, respectively.

13. In a chair according to claim 12, wherein said lower leg portion forms a cover complementary to said support means and for protecting portions of said tension control means.

14. In a chair according to claim 9, wherein said stiffening means comprises a straplike leaf spring interposed between said upper and lower leg portions; and said engaging means adjustable engages said leaf spring along a longitudinal axis thereof, said mounting means rotatably mounting said engaging means to said support means through said elongated opening for rotational movement between front and rear positions relative to said leaf spring;

whereby movement of said engaging means toward said rear position decreases the effective length of said leaf spring and said moment arm length to thereby increase said leaf spring's resistance to deflection of said upper leg portion, and movement of said engaging means toward said front position increases said moment arm length to thereby decrease said leaf spring's resistance to deflection of said upper leg portion.

15. In a chair according to claim 14, wherein said support means further comprises a threaded vertical bore and an enlarged channel aligned with said elongated opening;

said lower leg portion further comprises a pair of spaced sidewalls;

said leaf spring is substantially straight and has a lower front end and an upper rear curved end slidably engaging said upper leg portion;

said tension control means further comprises a means for securely retaining said leaf spring lower front end to said lower leg portion for nonmovement with respect thereto;

said engaging means comprises an asymmetrical cam pad rotatably mounted about a horizontal axis of rotation by a pin mounted to and between said sidewalls, said cam pad being in registry with said aligned channel and opening; and said actuating means comprises a threaded rod having upper and lower ends, threadably received in said vertical bore at upper inner end and extending downwardly below said support means at said lower end;

whereby rotation of said rod in a first direction moves said rod upwardly relative to said support means to force said cam pad to rotate to said rear position relative to said leaf spring to shorten the effective length of the same and said moment arm length and increase said leaf spring's resistance to relative deflection of said upper leg portion, and rotation of said rod in a second direction moves said rod downwardly relative to said support means to force said cam pad to rotate to said front position relative to said leaf spring to lengthen said moment arm length to decrease said leaf spring's resistance to relative deflection of said upper leg portion.

* * * * *